US007439465B2

(12) United States Patent
Parkinson

(10) Patent No.: US 7,439,465 B2
(45) **Date of Patent: *Oct. 21, 2008**

(54) SWITCH ARRAYS AND SYSTEMS EMPLOYING THE SAME TO ENHANCE SYSTEM RELIABILITY

(75) Inventor: Wayne Parkinson, Phoenix, AZ (US)

(73) Assignee: White Electronics Designs Corporation, Pheonix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/757,271

(22) Filed: Jun. 1, 2007

(65) Prior Publication Data

US 2007/0278082 A1 Dec. 6, 2007

Related U.S. Application Data

(63) Continuation-in-part of application No. 11/218,854, filed on Sep. 2, 2005.

(51) Int. Cl.
*H01H 1/10* (2006.01)

(52) U.S. Cl. ..... 200/512; 200/514

(58) Field of Classification Search ..... 200/511–514; 338/47, 99, 114; 345/55
See application file for complete search history.

(56) References Cited

U.S. PATENT DOCUMENTS 3,688,066 A * 8/1972 Adelson et al. ..... 200/512
4,090,092 A 5/1978 Serrano
4,121,204 A 10/1978 Welch et al.
4,233,522 A 11/1980 Grummer et al.
4,293,987 A 10/1981 Gottbreht et al.
4,304,976 A 12/1981 Gottbreht et al.
4,527,021 A * 7/1985 Morikawa et al. ..... 200/5 A
4,561,002 A 12/1985 Chiu
4,656,469 A 4/1987 Oliver et al.
4,894,493 A 1/1990 Smith et al.
5,120,912 A 6/1992 Sharp
5,149,923 A * 9/1992 Demeo ..... 200/5 A
5,397,867 A 3/1995 Demeo
5,810,604 A 9/1998 Kopp et al.
6,054,664 A * 4/2000 Ariga et al. ..... 200/512

(Continued)

OTHER PUBLICATIONS

CD4503B Types; Texas Instrument Data Sheet Acquired from Harris Semiconductor; Oct. 2003; p. 3-238; Texas Instrument Incorporated, USA.

*Primary Examiner*—Elvin Enad
*Assistant Examiner*—Lisa N Klaus
(74) *Attorney, Agent, or Firm*—Allen J. Moss; Squire, Sanders & Dempsey, L.L.P.

(57) ABSTRACT

An input system is delineated comprising an array of touch regions. At least one touch region is aligned with a sensing structure. The sensing structure comprises a first conductive region; a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed. Also delineated is a control panel including a plurality of such switches, as well as an appliance including such a control panel.

31 Claims, 9 Drawing Sheets

U.S. PATENT DOCUMENTS 6,114,645 A 9/2000 Burgess
6,121,869 A 9/2000 Burgess
6,448,518 B1 * 9/2002 Martin et al. ..... 200/292
6,492,911 B1 12/2002 Netzer
6,504,492 B1 * 1/2003 Muurinen ..... 341/22
6,552,288 B2 * 4/2003 Ono ..... 200/512
6,573,467 B1 * 6/2003 Nakanishi et al. ..... 200/406
6,603,086 B2 * 8/2003 Kawaguchi et al. ..... 200/517
6,664,489 B2 12/2003 Kleinhans et al.
6,674,028 B1 * 1/2004 Berton ..... 200/61.52
6,743,993 B1 6/2004 Clark et al.
6,746,336 B1 6/2004 Brant et al.
6,767,596 B2 7/2004 Hayakawa et al.
D495,336 S 8/2004 Andre et al.
6,787,722 B2 * 9/2004 Tsutsui ..... 200/512
6,788,220 B2 9/2004 Netzer
6,799,226 B1 9/2004 Robbin et al.
6,841,748 B2 * 1/2005 Serizawa et al. ..... 200/512
6,897,390 B2 5/2005 Caldwell et al.
6,967,299 B2 * 11/2005 Howie et al. ..... 200/512
7,030,329 B1 * 4/2006 Sneek et al. ..... 200/292
D525,616 S 7/2006 Andre et al.
7,072,477 B1 7/2006 Kincaid
7,102,155 B2 9/2006 Ando et al.
7,106,221 B2 9/2006 Horton et al.
7,146,437 B2 12/2006 Robbin et al.
7,159,957 B2 1/2007 Huber et al.
7,166,791 B2 1/2007 Robbin et al.
7,186,938 B2 * 3/2007 Ito ..... 200/512
2001/0037933 A1 11/2001 Hunter et al.
2003/0011225 A1 1/2003 Barcesat
2003/0132094 A1 7/2003 Mickle et al.
2004/0069607 A1 4/2004 Hunter et al.
2004/0224638 A1 11/2004 Fadell et al.
2005/0015254 A1 1/2005 Beaman
2005/0115248 A1 6/2005 Koehler et al.
2006/0107822 A1 5/2006 Bowen
2006/0156236 A1 7/2006 Heller et al.
2006/0156239 A1 7/2006 Jobs et al.
2006/0161870 A1 7/2006 Hotelling et al.
2006/0161871 A1 7/2006 Hotelling et al.
2006/0197750 A1 9/2006 Kerr et al.
2006/0250764 A1 11/2006 Howarth et al.
2006/0268528 A1 11/2006 Zadesky et al.
2007/0028006 A1 2/2007 Laefer et al.
2007/0028109 A1 2/2007 Wysocki et al.
2007/0030963 A1 2/2007 Wyld et al.

* cited by examiner

SWITCH ARRAYS AND SYSTEMS EMPLOYING THE SAME TO ENHANCE SYSTEM RELIABILITY

CROSS-REFERENCE TO RELATED APPLICATIONS

This application is a continuation-in-part of and claims priority to U.S. patent application Ser. No. 11/218,854, filed Sep. 2, 2005, which is filed in the name of the same inventor and incorporated herein by reference.

BACKGROUND OF THE INVENTION

1. Field of the Invention

The present invention relates to switches and, more particularly, to switch arrays and systems employing the same to enhance system reliability and control.

2. Description of the Related Art

As used herein, the term "membrane switch" means a switch including a plurality of conductive regions with at least one of the conductive regions located on a layer of flexible material.

Current membrane switches may include a first conductive region on a first layer of material aligned over a second conductive region on a second layer of material. A flexible material may be used for one or both of the first and second layers. One of the conductive regions may include interdigitated fingers forming a pair of terminals for the switch. Normally, the conductive regions do not make contact with each other and the switch is open. When a user presses one of the conductive regions such that the two conductive regions touch, a circuit is completed across the interdigitated fingers to close the switch. A spacer material is typically located between the two layers to prevent inadvertent contact of the conductive regions and switch closure. Apertures in the spacer material leave exposed the conductive regions, so they may be selectively engaged to close the switch. The thickness of the spacer material is typically in the range of 0.006 inches to 0.012 inches.

Reducing the thickness of the spacer material may improve the feel of the switch to the user. For example, by reducing the thickness of the spacer material, the touching of a conventional membrane switch to close the switch may feel to the user more like touching of a capacitive touch switch, which is a higher-end, more expensive switch. However, it is currently impractical to reduce the spacer material thickness in a membrane switch below the currently-employed range, because in doing so, one would cause inadvertent switch operation due to temperature and/or pressure gradients.

Thus, there was a need to overcome these and other limitations in membrane switches, whether the improvements thereof are employed in membrane switches, any other switch design or in switch arrays thereof.

SUMMARY OF THE INVENTION

In accordance with one embodiment of the invention, an input system is disclosed comprising an array of touch regions, wherein at least one of the touch regions is aligned with a sensing structure for sensing a user input, the sensing structure comprising a first conductive region; a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed.

In accordance with another embodiment of the invention, a control panel is disclosed comprising a first support layer; a second support layer; a spacer between the first support layer and the second support layer; and an array of touch regions on one or more of the first support layer and the second support layer, wherein at least one of the touch regions is aligned with a sensing structure for sensing a user input, the sensing structure comprising a switch between the first support layer and the second support layer, the switch comprising a first conductive region; a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed.

In accordance with yet another embodiment of the invention, a system is disclosed comprising an appliance; and a control panel coupled to the appliance for controlling the appliance, the control panel comprising a first support layer; a second support layer; a spacer between the first support layer and the second support layer; and an array of touch regions on one or more of the first support layer and the second support layer, wherein at least one of the touch regions is aligned with a sensing structure for sensing a user input, the sensing structure comprising a switch between the first support layer and the second support layer, the switch comprising a first conductive region; a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Figure 1A:
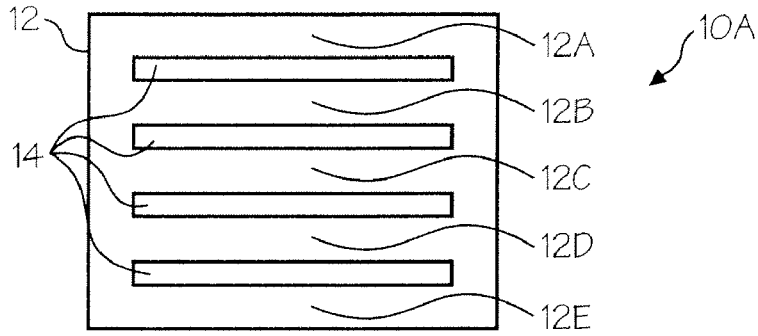
FIG. 1A is a plan view of a portion of a switch, in accordance with systems consistent with the present invention.
Figure 1B:
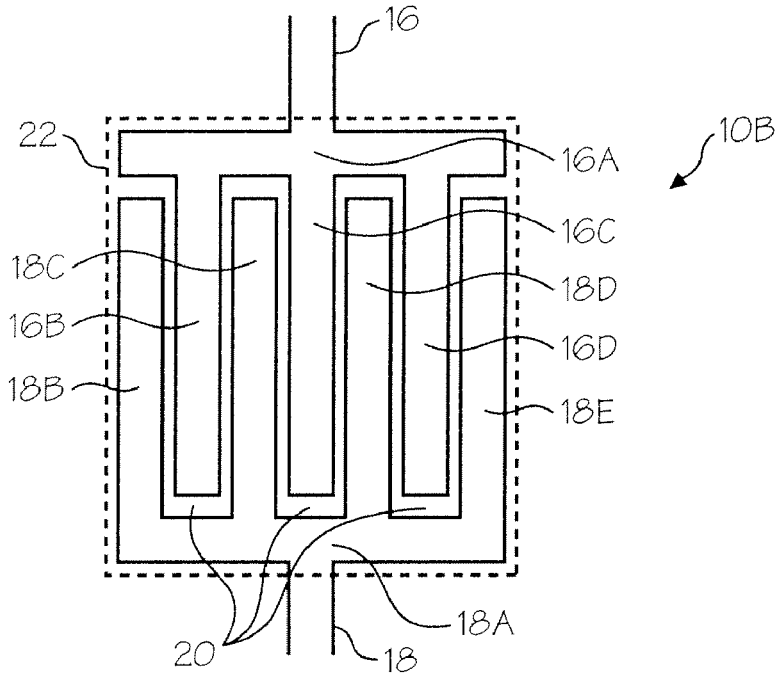
FIG. 1B is a plan view of another portion of a switch, which may be used at least with that portion shown in FIG. 1A, in accordance with systems consistent with the present invention.
Figure 1C:
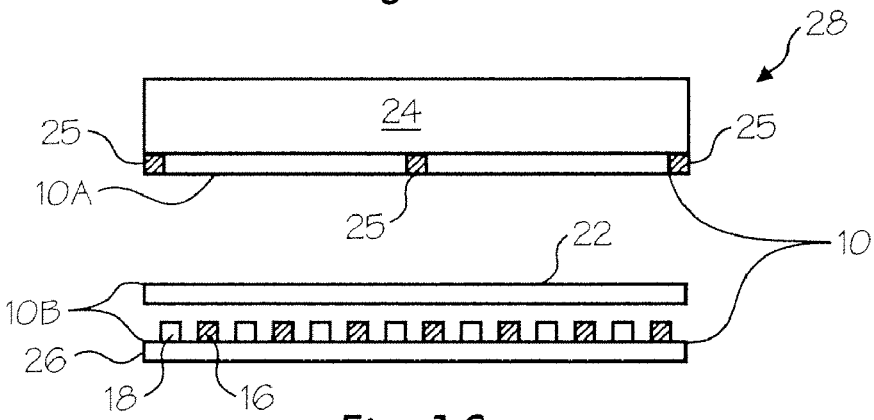
FIG. 1C is a cross-sectional view of a control panel employing a plurality of switches, which may be formed by a corresponding plurality of switch portions, as shown by way of example in FIG. 1A and FIG. 1B, in accordance with systems consistent with the present invention.

FIG. 1A is a plan view of a conductive region 10A of a switch 10, as show in cross section in FIG. 1C. FIG. 1B is a plan view of a conductive region 10B of switch 10. As shown in FIG. 1C, conductive region 10A is vertically aligned with conductive region 10B. A single switch 10 may be formed by vertically aligning conductive region 10A with conductive region 10B, as shown in FIGS. 1A and 1B, however, as is evident, a plurality of such switches 10 are represented in FIG. 1C, each of such switches 10 including a conductive region 10A vertically aligned with a corresponding conductive region 10B. Those skilled in the art understand that conductive regions 10A and 10B, as well as switch 10 (and control panel 28), are not necessarily shown to scale. For example, as is evident from the description herein, one or more spacers 25, as shown in FIG. 1C, typically extend below conductive region 10A, to maintain some amount of physical separation between conductive regions 10A and 10B when switch 10 is (electrically and physically) open, though, if desired, the one or more spacers 25 may not extend below conductive region 10A, in which case conductive regions 10A and 10B may touch, even when switch 10 is (only electrically) open.

Referring to FIG. 1A, conductive region 10A may include a plurality of conductive members 12A, 12B, 12C, 12D and 12E (collectively, "conductive members 12"). Conductive members 12 may be arranged in parallel, as shown in FIG. 1A. A plurality of spaces 14 may separate conductive members 12. Conductive region 10A may comprise any conductive material, such as a metal. Moreover, conductive region 10A may have any shape suitable for making electrical contact with conductive region 10B.

Figure 6A:
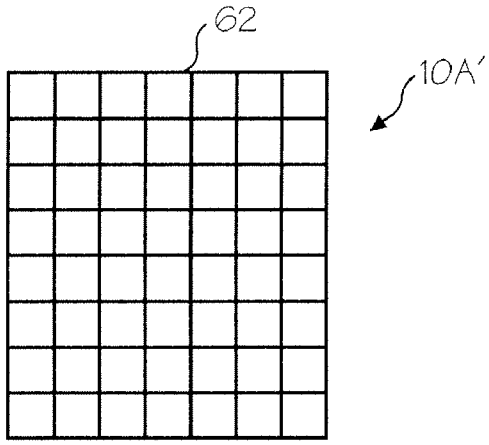
FIGS. 6A-6C are plan views of variations to the portion of the switch shown in FIG. 1A, in accordance with systems consistent with the present invention.
Figure 6B:
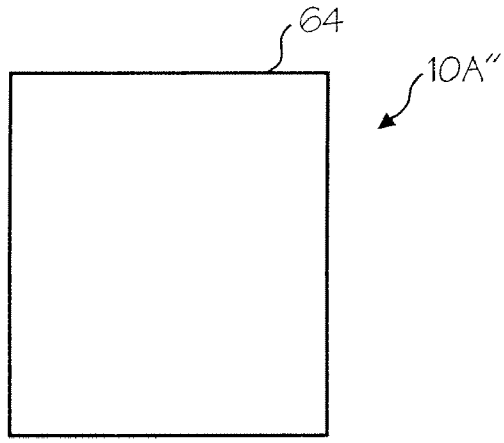
Figure 6C:
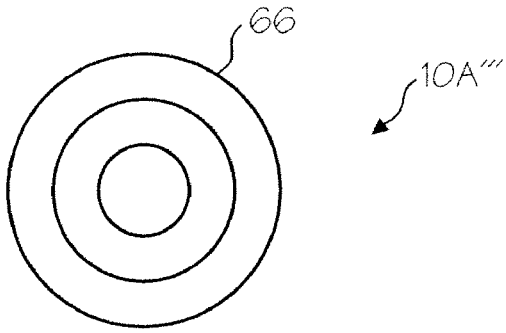

FIGS. 6A-6C comprise a non-exhaustive showing of alternative shapes that may be employed in lieu of the shape of conductive region 10A shown in FIG. 1A, respectively labeled conductive region 10A', 10A" and 10A'". In FIG. 6A, conductive region 10A' may include a plurality of conductive members 62, including a vertically-arranged set of parallel conductive members orthogonally-arranged with respect to a horizontally-arranged set of parallel conductive members. In FIG. 6B, conductive region 10A" may include one or more conductive plates 64. In FIG. 6C, conductive region 10A'" may include a plurality of concentrically-arranged conductive members 66. However, those skilled in the art understand that conductive region 10A may take any shape suitable for making electrical contact with conductive region 10B, including the shapes shown in FIGS. 1A and 6A-6C.

Referring to FIG. 1B, conductive region 10B may include a plurality of conductive patterns 16 and 18 separated by a space 20. As represented in FIGS. 1B and 1C, conductive region 10B may also include conductive region 22, though conductive region 22 may be regarded as a distinct conductive region separate from but coupled to conductive region 10B. Accordingly, at times set forth herein for purposes of clarity conductive region 10B will refer to patterns 16 and 18 and not conductive region 22.

Figure 2:
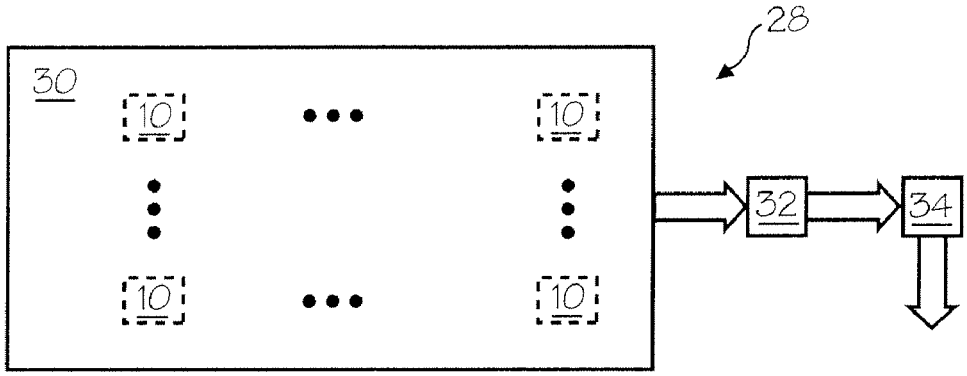
FIG. 2 is a block diagram of a control panel employing a plurality of switches, in accordance with systems consistent with the present invention.

Conductive pattern 16 may include a base member 16A and a plurality of parallel finger members 16B-16D extending orthogonally from base member 16A. Similarly, conductive pattern 18 may include a base member 18A and a plurality of parallel finger members 18B-18E extending orthogonally from base member 18A. As shown in FIG. 1B, conductive patterns 16 and 18 form an interdigitated finger pattern, those skilled in the art understanding that more or fewer finger members, such as 16B-16D and 18B-18E, may be employed. Conductive patterns 16 and 18 may be coupled to a detector 32, as shown in FIG. 2, for determining whether switch 10 is closed, by coupling to the pattern extensions shown at the top of conductive pattern 16 and at the bottom of conductive pattern 18. Conductive patterns 16 and 18 may comprise any conductive material, such as a metal. Moreover, conductive patterns 16 and 18 may take any shape suitable for making electrical contact with conductive region 10A.

Figure 5:
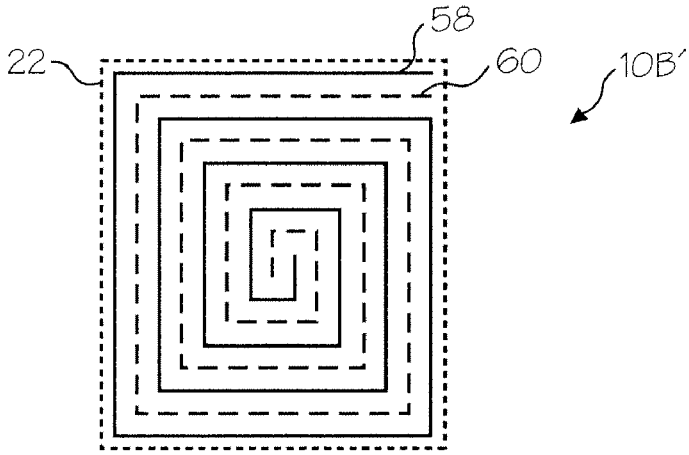
FIG. 5 is a plan view of a variation to the portion of the switch shown in FIG. 1B, in accordance with systems consistent with the present invention.

For example, FIG. 5 depicts an alternative shape (a nonexhaustive showing) that may be used in lieu of the shape of conductive region 10B shown in FIG. 1B, labeled conductive region 10B', which may include conductive patterns 58 and 60 separated by a space. For purposes of clarity, conductive region 22, as shown in FIG. 5 as well as in FIG. 1B, will be discussed separately below. Conductive patterns 58 and 60 form a plurality of spiral patterns, with straight edges and squared corners, however, those skilled in the art understand that the spiral patterns may be rounded. Moreover, those skilled in the art understand that conductive patterns, such as 16 and 18 or 58 and 60, included in conductive regions 10B and 10B', respectively, may take any shape suitable for making electrical contact with conductive region 10A, including the shapes shown in FIGS. 1B and 5.

Referring to FIG. 1B, a conductive region 22 may be applied over portions of conductive patterns 16 and 18, thus making electrical contact between the switch terminals formed by patterns 16 and 18. Conductive region 22 may comprise any material suitable for providing relatively high resistance across open switch terminals (when switch 10 is not closed), i.e., any open-switch resistance that is easy to detect relative to a decreased resistance across switch 10 that results from switch closure. For example, by providing with conductive region 22 a resistance across open switch terminals of greater than or equal to one Mega-ohm, it may be easy to detect a resistance decrease to 500 Kilo-ohms or less across closed switch terminals.

In one embodiment, conductive region 22 may comprise a conductive ink, such as a carbon ink. Such an ink may provide relatively high resistance across open switch terminals, i.e., any open-switch resistance that is easy to detect relative to a decreased resistance across switch 10 that results from switch closure. Due to the switch terminals being electrically coupled together by conductive region 22, electric current may flow between the switch terminals, whether switch 10 is open or closed. It is not a necessity that conductive region 22 cover all of patterns 16 and 18, as covering any portion thereof, including covering all portions thereof, may be sufficient.

Referring to FIG. 1C, a cross sectional view is shown of a control panel 28 having a plurality of switches 10, each of such switches 10 including a conductive region 10A vertically aligned with corresponding conductive region 10B. Control panel 28 may include a first support layer 24, a second support layer 26, as well as a plurality of switches 10 formed between support layers 24 and 26. In one embodiment, support layer 24 and/or support layer 26 may comprise any flexible material, such as a polycarbonate material or any type of flexible substrate material. For example, in the former case, support layer 24 may comprise a polycarbonate layer having a thickness in the range of 0.005 inches to 0.030 inches, or more preferably in the range of 0.015 inches to 0.030 inches, e.g., 0.020 inches. Having a thickness for support layer 24 in either of these ranges (but particularly in the preferred range) gives support layer 24 (which will be viewable to a user of control panel 28) a richer appearance, e.g., a glass-like finish as may be found in higher-end, more expensive control panels employing capacitive touch switches.

To form switches 10, a plurality of conductive regions 10A may be formed on a surface of support layer 24 using any suitable technique, such as by printing any conductive ink, .e.g., a silver ink. Alternatively, a plurality of conductive regions 10A may be formed on a surface of another layer (not shown) attached to support layer 24. Using any suitable technique, a spacer 25 may be applied to the same surface of support layer 24 in those areas not including conductive regions 10A. Thus, this surface of support layer 24 (the surface of support layer 24 that is located opposite from the surface that a user would touch to close one of switches 10, the faceplate 30, as shown in FIG. 2) may have formed thereon a plurality of conductive regions 10A and a spacer material 25 in those areas on the surface where conductive regions 10A do not reside. In one embodiment, the spacer material 25 may comprise any adhesive material suitable for binding the upper portion of control panel 28, i.e., support layer 24 and conductive regions 10A, to the lower portion of control panel 28, i.e., support layer 26 and conductive regions 10B (as discussed below, lower portion of control panel 28 may also include a series of traces that are coupled to conductive regions 10B and a dielectric layer covering portions of such traces). In one embodiment, the thickness of the applied spacer material 25 may be below 0.012 inches, or more preferably below 0.006 inches, e.g., 0.001 to 0.002 inches. As noted above, while spacer 25 may comprise any adhesive material suitable for binding the upper portion of control panel 28 to the lower portion of control panel 28, spacer 25 typically extends below conductive region 10A, to maintain some amount of physical separation between conductive regions 10A and 10B when switch 10 is (electrically and physically) open.

Turning to the lower portion of control panel 28, in one embodiment, support layer 26 may comprise a flexible substrate material, such as a polyester material. Alternatively, support layer 26 may comprise a rigid material, such as a printed circuit board. For example, in the former case, support layer 26 may comprise a polyester material having a thickness in the range of 0.003 inches to 0.010 inches, or more preferably in the range of 0.005 inches to 0.007 inches.

A plurality of conductive regions 10B (here, referring to the patterns 16 and 18 and not the conductive regions 22) may be formed on a surface of support layer 26 using any suitable technique, such as by printing any conductive ink, .e.g., a silver ink. The width of the traces forming patterns 16 and 18, as well as the space there between, may comprise any desired dimension, however, in one embodiment, the width of the traces forming patterns 16 and 18 is 0.025 inches, while the width of the dividing space is 0.015 inches. Additional traces may be applied using any suitable technique to couple each pattern 16 and 18 of each switch 10 to a detector 32, as shown in FIG. 2, for determining whether each switch 10 is open or closed. For example, such additional traces may be coupled to each pattern 16 and 18 of each switch 10 at the pattern extensions shown at the top of conductive pattern 16 and at the bottom of conductive pattern 18, as seen in FIG. 1B.

A layer of dielectric material may also be applied to cover exposed traces to prevent undesired shorting, however, the traces forming the plurality of conductive regions 10B (here, referring to patterns 16 and 18 and not conductive region 22) of each switch 10 would not be covered by the dielectric layer. Instead, on each of the plurality of conductive regions 10B (again, referring to patterns 16 and 18 and not conductive regions 22), a conductive region 22 may be applied using any suitable technique, such as by printing a high resistance material across the switch terminals, i.e., portions of patterns 16 and 18. In one embodiment, the high resistance material may comprise a high resistance carbon ink.

The upper portion of control panel 28, i.e., support layer 24 and conductive regions 10A, may be registered with and bonded to (with, for example, the adhesive spacer material 25) the lower portion of control panel 28, i.e., support layer 26, conductive regions 10B (here, referring to patterns 16 and 18, as well as conductive regions 22) and the additional traces (and the related dielectric layer covering such additional traces) for coupling patterns 16 and 18 to detector 32. In such an arrangement, each switch 10 has a conductive region 10A aligned and typically not in contact with a respective conductive region 22 that is electrically coupled to corresponding patterns 16 and 18.

Referring to FIG. 2, control panel 28 may include a faceplate 30 (the upper surface of support layer 24) including markings (not shown) to indicate to a user which switch 10 to touch for the indicated functionality. For example, there may be switches 10 to turn on an appliance, to turn off an appliance, to set a clock, to set a temperature for an appliance or to set or adjust any desired feature of an appliance. Switches 10 are shown in phantom lines in FIG. 2 to represent that they lie beneath support layer 24 where they are indicated by appropriate markings (not shown) on faceplate 30. The three-dot chains between switches 10 represent that any desired number of switches 10 may be employed in control panel 28.

Control panel 28 may be coupled to detector 32, which may reside in, on or outside control panel 28. For example, traces may couple each pattern 16 and 18 of each switch 10 to detector 32 for determining whether each switch 10 is open or closed. Any detector suitable for this purpose may be employed, however, in one embodiment, detector 32 may detect resistance across terminals of each switch 10 and use a predefined condition to determine whether a switch is open or closed. For example, detector 32 may sense a high resistance across open switch terminals, i.e., any open-switch resistance that is easy to detect relative to a decreased resistance across switch 10 that results from switch closure. Thus, when, for example, detector 32 detects a high resistance across open switch terminals, e.g., a resistance of greater than or equal to one Mega-ohm, or a low resistance across closed switch terminals, e.g., a resistance of 500 Kilo-ohms or less, detector 32 may be provide an indication to controller 34 reporting the position of each switch 10. Detector 32 may provide indications of the position of one or more switches at a time. In one embodiment, a CMOS Hex Buffer available from Texas Instruments, Inc. under part no. CD4503B may be employed for detector 32. Any controller 34 suitable for receiving switch position information from detector 32 and employing the same to control an appliance or device may be used.

Figure 3:
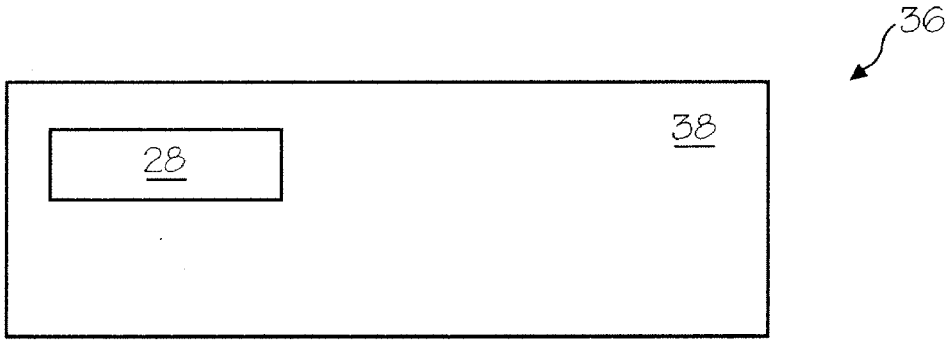
FIG. 3 is a block diagram of an appliance including a control panel employing a plurality of switches, in accordance with systems consistent with the present invention.

FIG. 3 shows a system 36 including an appliance 38 and one or more control panels 28 for controlling features of appliance 38 (detector 32 and/or controller 34 may reside in, on or outside of control panel 28). Appliance 38 may comprise anything with controllable features, such a home, office or other type of appliance, such as a washing machine, a drying machine, a microwave oven, a range, a convection oven, a dishwasher, a trash compactor, a photocopier, a facsimile machine, etc.

Figure 4A:
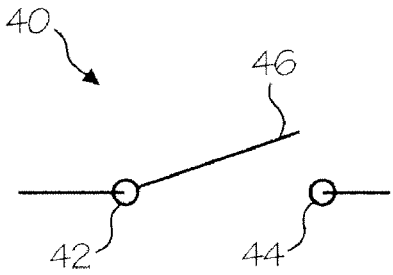
FIG. 4A is an electrical schematic model of a switch, in accordance with prior art systems.

FIG. 4A is an electrical schematic model of a switch 40, in accordance with prior art systems. Switch 40 includes terminals 42 and 44, as well as an operating arm 46 that, in a first position (as shown), leaves switch 40 open, preventing current flow between terminals 42 and 44 (assuming that the terminals are tied to a power supply and ground, neither of which are shown). In a second position, operating arm 46 moves down to electrically couple terminals 42 and 44, thus closing switch 40 and permitting current flow.

Figure 4B:
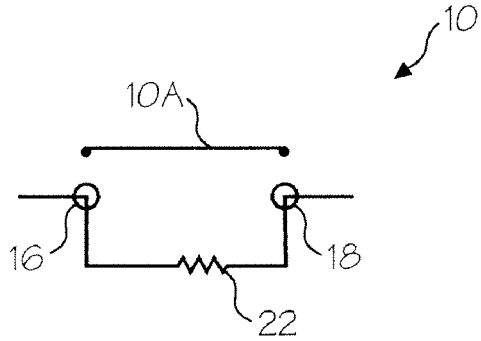
FIG. 4B is an electrical schematic model of a switch, in accordance with systems consistent with the present invention.

FIG. 4B is an electrical schematic model of switch 10. Switch 10 includes terminals (patterns 16 and 18), as well as conductive regions 10A and 22. Terminals (or patterns 16 and 18) are electrically coupled together through conductive region 22, which provides a relatively high resistance when switch 10 is open (as shown), e.g., greater than or equal to one Mega-ohm. Referring to FIG. 1C, conductive region 10A typically does not touch conductive region 22 when switch 10 is open, as is represented in FIG. 4B. When a user depresses conductive region 10A forcing it against conductive region 22, an alternative (and lower resistance) flow path is established between terminals 16 and 18. The lower resistance, e.g., 500 Kilo-ohms or less, may be used by detector 32 to detect that switch 10 is shut.

Referring to FIGS. 7A-7E, plan views are shown of various touch region outline shapes. As used herein, "touch region" means any region on a surface of an object that a user may touch to initiate generation of an input to the object or to any other object. Typically, a sensing structure would be aligned with and below a touch region, so that when a user touches the region, the sensing structure detects the touching and initiates generation of an input.

Figure 7A:
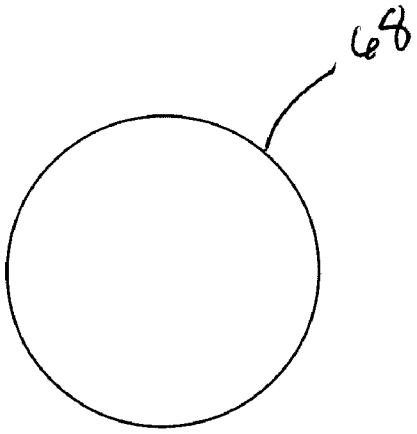
FIGS. 7A-7E are plan views of touch region outline shapes, in accordance with systems consistent with the present invention.
Figure 7B:
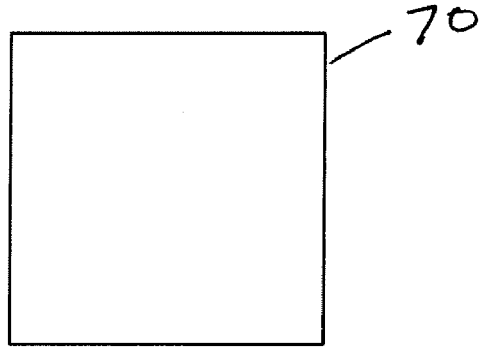
Figure 7C:
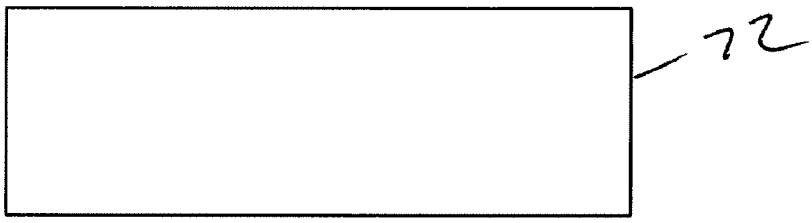
Figure 7D:
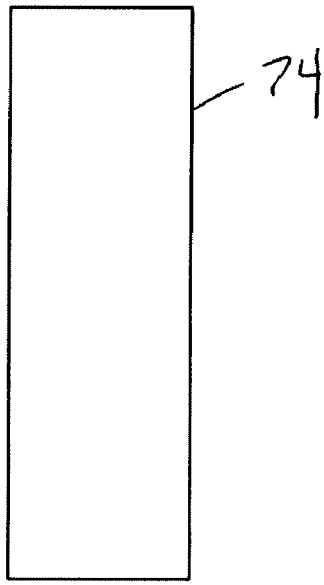
Figure 7E:
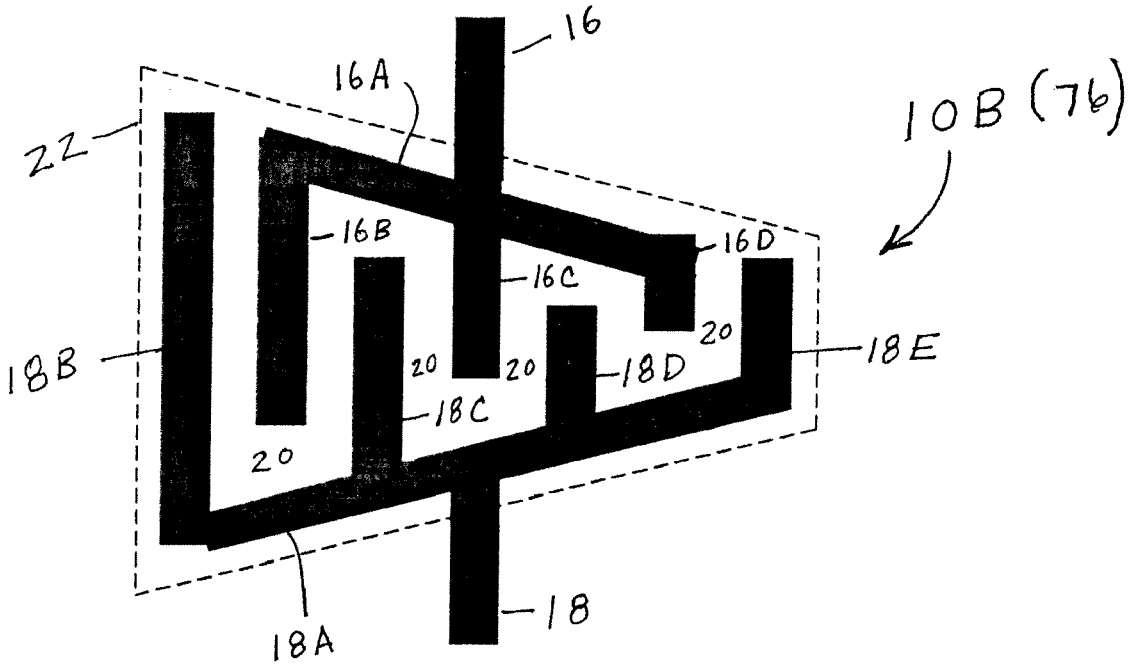

The present invention may employ touch regions having any desired shape or size. FIGS. 7A-7E depicts several exemplary touch region outline shapes, such as a circle 68, a square 70, a horizontally-registered rectangle 72, a vertically-registered rectangle 74 and a trapezoid 76, as respectively shown in FIGS. 7A-7E. The size and shape (or footprint) of any touch region may be less than, greater than or equal to the size and shape (or footprint) of any aligned sensing structure. For example, FIG. 7E shows a trapezoidal touch region 76 sized and shaped to effectively match the footprint of an aligned sensing structure, which in this case is represented by switch 10 (for ease of depiction, however, only conductive region 10B of switch 10 is shown, and those skilled in the art understand that a similarly shaped and sized conductive region 10A may be employed). Those skilled in the art further understand that conductive regions 10A and 10B may be sized and shaped to match the footprints depicted in FIGS. 7A-7D in a manner analogous to that shown by FIGS. 1-6.

Figure 8A:
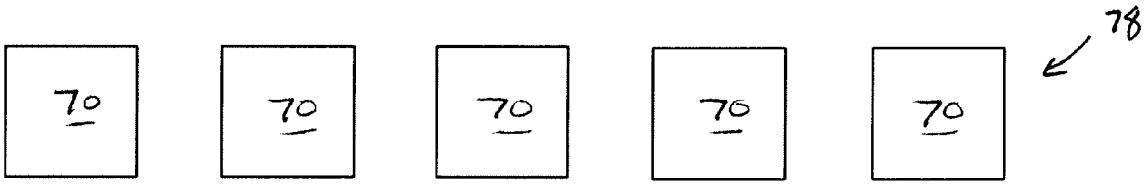
FIGS. 8A-8E are plan views of arrays of touch regions forming open array patterns, in accordance with systems consistent with the present invention.
Figure 8B:
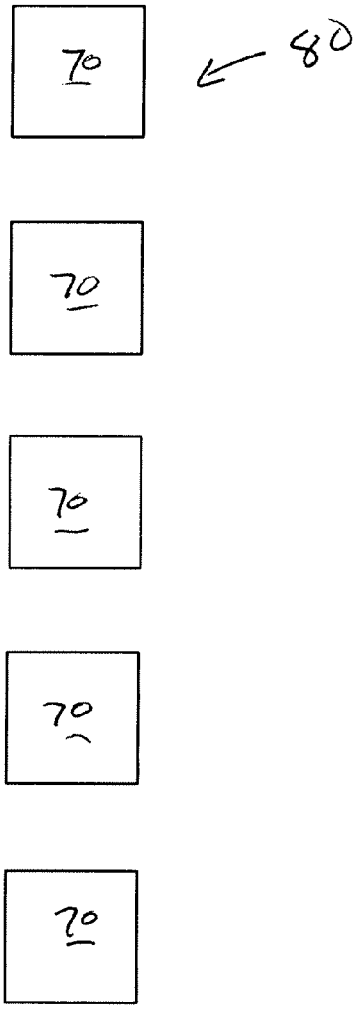
Figure 8C:
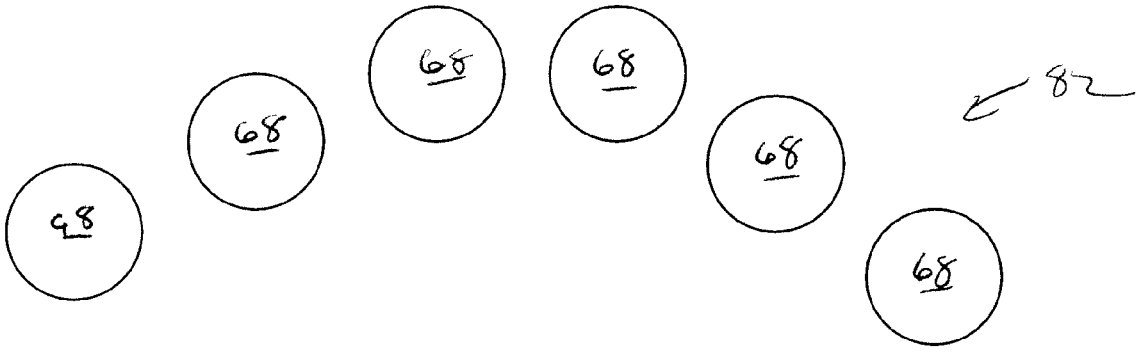
Figure 8D:
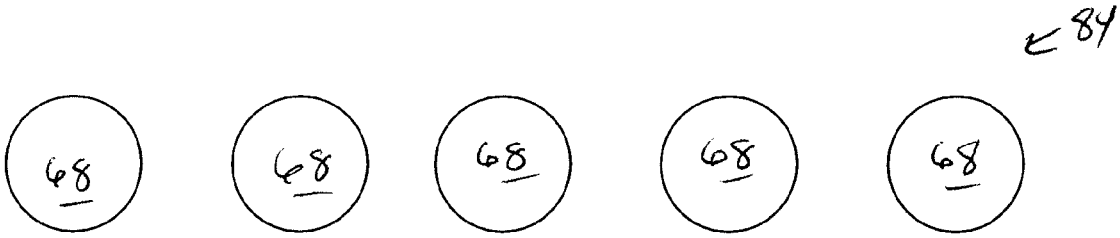
Figure 8E:
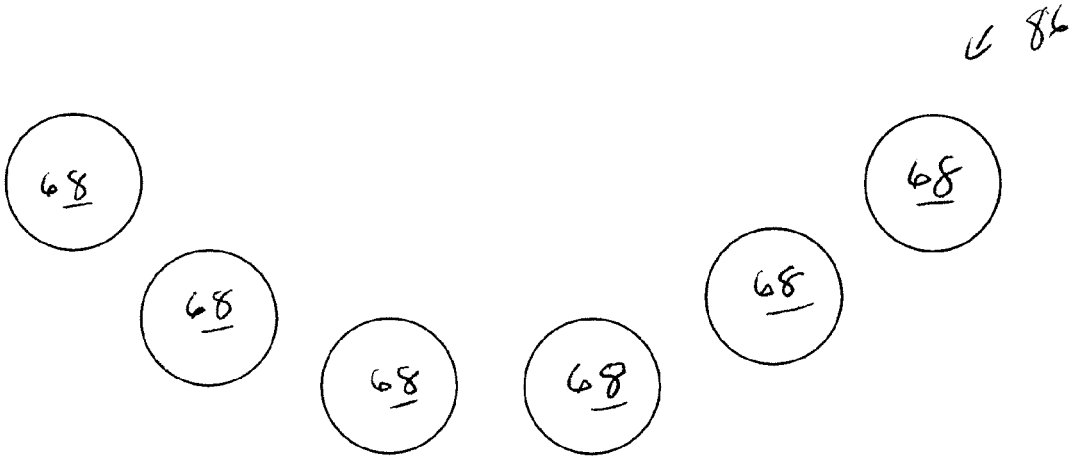

Referring to FIGS. 8A-8E, plan views are shown of arrays of touch regions forming open array patterns. FIG. 8A shows a horizontal linear array 78 of touch regions 70 arranged in an open pattern. Here, "open" means that one end of the array of touch regions is not adjacent to the other end of the array. FIG. 8B shows a vertical linear array 80 of touch regions 70 arranged in an open pattern. FIG. 8C shows a horizontal arc array 82 of touch regions 68 arranged in an open pattern. FIG. 8D shows a horizontal linear array 84 of touch regions 68 arranged in an open pattern. FIG. 8E shows another horizontal arc array 86 of touch regions 68 arranged in an open pattern.

The aforementioned and following touch region arrays are exemplary only, as any combination of touch regions may be used (i.e., any desired shape and/or size touch region may be used; moreover, in an array of touch regions, not all touch regions must be of the same shape and size) to form any desired array shape or size. An array of touch regions will typically include a plurality of touch regions in close proximity to one another, so a user may slide an input actuator, e.g., a pointer, a finger, across the array of touch regions to generate a sequence of input signals that may be used to control a device.

Figure 9:
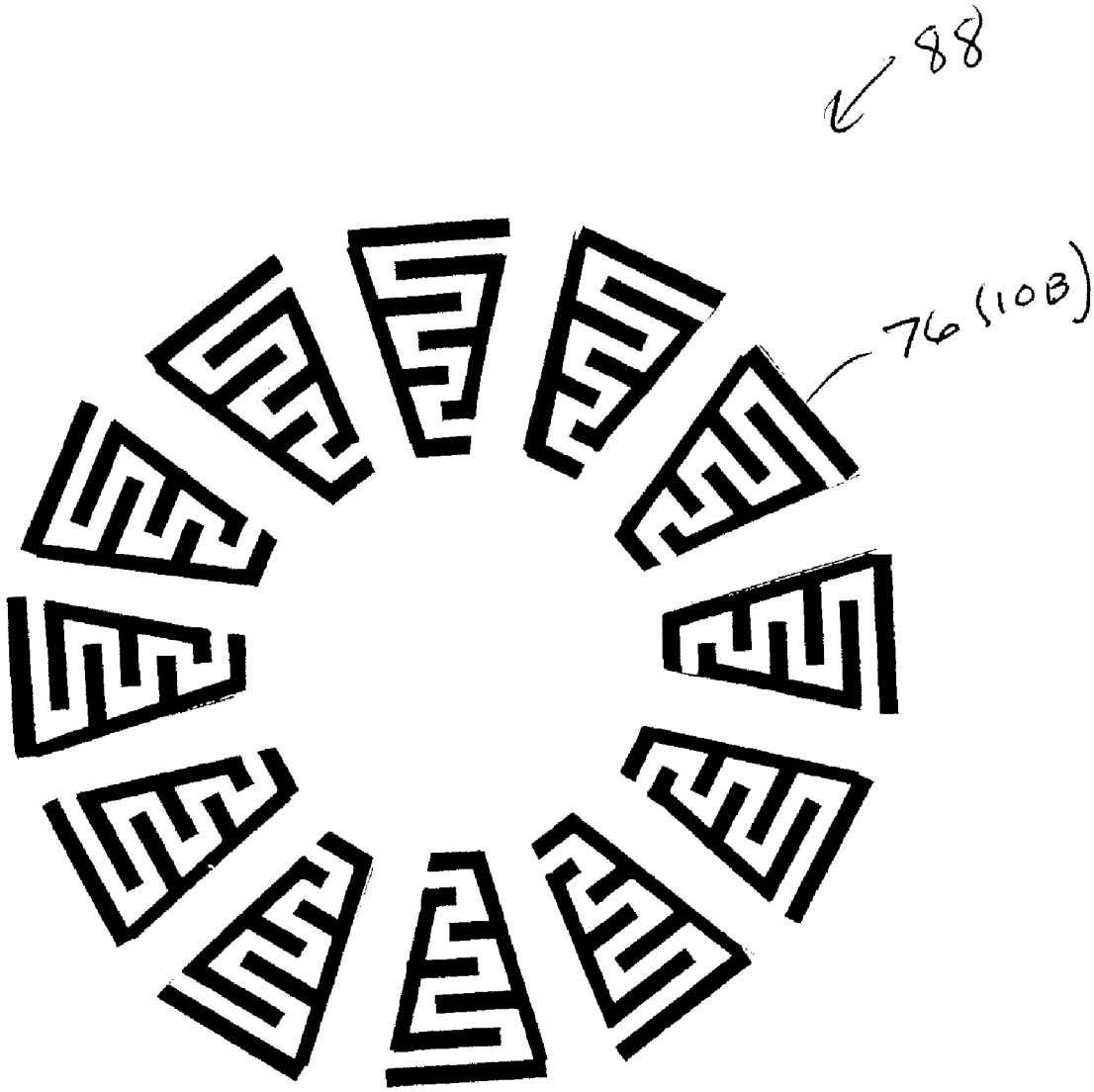
FIG. 9 is a plan view of an array of touch regions forming a closed array pattern, in accordance with systems consistent with the present invention.
Figure 10:
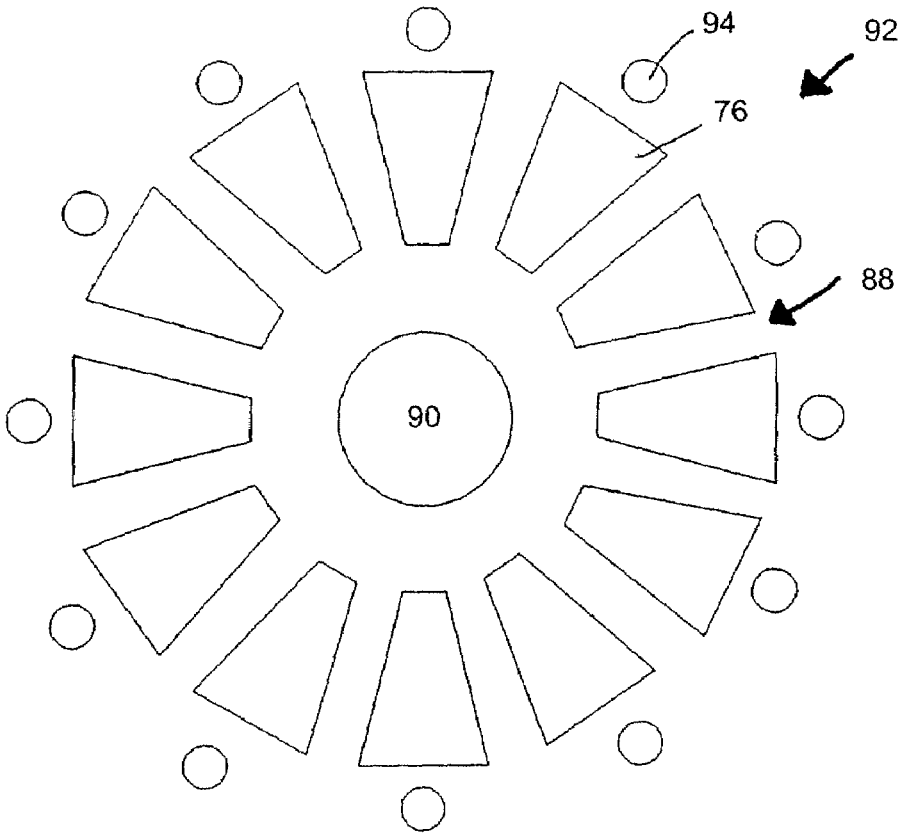
FIG. 10 is a plan view of an array of touch regions forming a closed array pattern, in accordance with systems consistent with the present invention.

FIG. 9 shows a circular array 88 of touch regions 76 arranged in a closed pattern. For drawing simplification, touch regions 76 are shown with only a portion of switches 10, namely the conductive regions 10B. FIG. 10 shows a circular array 88 of touch regions 76 arranged in a closed pattern. For drawing simplification, touch regions 76 are shown without switches 10, it being understood that some form of sensing structure (such as switch 10) may underlie each touch region 76. Also shown in FIG. 10 is a touch region 90, under which a sensing structure may be utilized to make a selection for the device. For example, one may slide an input actuator, e.g., a pointer, a finger, across the array 88 to generate a sequence of input signals that may be used to control a device, such as moving a cursor across a list of displayed options. When the desired option is aligned with the cursor, a user may actuate a sensing structure beneath touch region 90 to select the desired option. Visual indicators, such as light emitting diodes (LEDs) 94, may be arranged around array 88 to emit light as a user contacts a corresponding sensing structure in the array 88.

Figure 11:
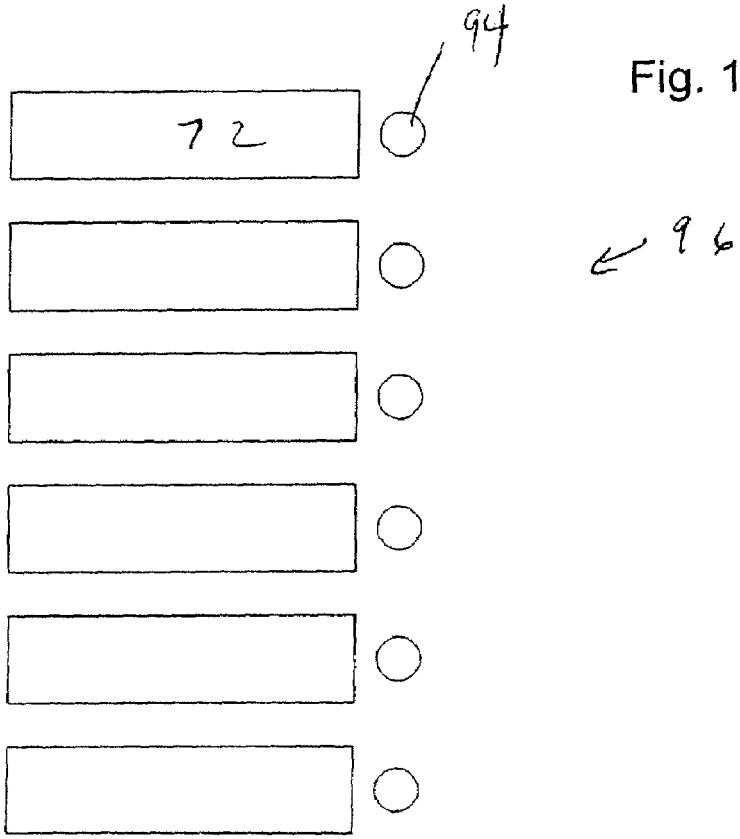
FIG. 11 is a plan view of an array of touch regions forming an open array pattern, in accordance with systems consistent with the present invention.

FIG. 11 shows a vertical array 96 of touch regions 72 arranged in an open pattern. For drawing simplification, touch regions 72 are shown without switches 10, it being understood that some form of sensing structure (such as switch 10) may underlie each touch region 72. Not shown in FIG. 11 is a touch region analogous to the touch region 90, shown in FIG. 10, however, such a select touch region may be utilized. Accordingly, one may slide an input actuator, e.g., a pointer, a finger, across the array 96 to generate a sequence of input signals that may be used to control a device, such as moving a cursor across a list of displayed options. When the desired option is aligned with the cursor, a user may actuate a sensing structure beneath a select touch region (not shown) to select the desired option. Visual indicators, such as LEDs 94, may be arranged along array 96 to emit light as a user contacts a corresponding sensing structure in the array 96.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An input system, comprising:

an array of touch regions, wherein at least one of the touch regions is aligned with a sensing structure for sensing a user input, the sensing structure comprising:

a first conductive region;

a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed;

wherein the plurality of conductive members comprises a first set of parallel members and a second set of parallel members, the first set being orthogonal to the second set.

2. The input system of claim 1 wherein the first conductive region comprises a plurality of conductive members.

3. The input system of claim 2 wherein the conductive members are parallel to each other.

4. The input system of claim 2 wherein the plurality of conductive members comprises a plurality of circular members arranged concentrically to each other.

5. The input system of claim 2 wherein the first conductive pattern and the second conductive pattern form a plurality of interdigitated fingers.

6. The input system of claim 5 wherein the interdigitated fingers are orthogonal to the plurality of conductive members.

7. The input system of claim 1 wherein the first conductive region comprises a conductive plate.

8. The input system of claim 1 wherein the first conductive pattern and the second conductive pattern form a plurality of spirals.

9. The input system of claim 1 wherein the third conductive region comprises a material applied over portions of the first conductive pattern and the second conductive pattern.

10. The input system of claim 9 wherein the material comprises an ink.

11. The input system of claim 10 wherein the ink comprises a carbon ink.

12. The input system of claim 1 wherein the first indication comprises an electrical resistance between the first terminal and the second terminal of greater than or equal to one Mega-ohm.

13. The input system of claim 1 wherein the second indication comprises an electrical resistance between the first terminal and the second terminal of less than one Mega-ohm.

14. The input system of claim 1 wherein electrical current flows between the first terminal and the second terminal whether the switch is open or closed.

15. The input system of claim 1 wherein a portion of the first conductive region contacts the third conductive region whether the switch is open or closed.

16. The input system of claim 1 wherein each touch region has an outline shape.

17. The input system of claim 16 wherein the outline shape includes one of a circular shape, a square shape, a rectangular shape and a trapezoidal shape.

18. The input system of claim 1 wherein the array of touch regions is linear, nonlinear or a combination thereof

19. The input system of claim 1 wherein the array forms one of a closed pattern and an open pattern.

20. The input system of claim 19 wherein the closed pattern comprises a circular shape.

21. A control panel, comprising:

a first support layer;

a second support layer;

a spacer between the first support layer and the second support layer; and an array of touch regions on one or more of the first support layer and the second support layer, wherein at least one of the touch regions is aligned with a sensing structure for sensing a user input, the sensing structure comprising a switch between the first support layer and the second support layer, the switch comprising:

a first conductive region;

a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed.

22. The control panel of claim 21 wherein the spacer has a thickness of less than or equal to 0.012 inches.

23. The control panel of claim 21 wherein at least one of the first support layer and the second support layer has a thickness in the range of 0.005 inches to 0.030 inches.

24. The control panel of claim 21 further comprising:

means for measuring resistance across the plurality of switches; and means for controlling an appliance in response to the measured resistance across one or more of the plurality of switches.

25. A system, comprising:

an appliance; and a control panel coupled to the appliance for controlling the appliance, the control panel comprising:

a first support layer;

a second support layer;

a spacer between the first support layer and the second support layer; and an array of touch regions on one or more of the first support layer and the second support layer, wherein at least one of the touch regions is aligned with a sensing structure for sensing a user input, the sensing structure comprising a switch between the first support layer and the second support layer, the switch comprising:

a first conductive region;

a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed.

26. The system of claim 25 wherein the spacer has a thickness of less than or equal to 0.012 inches.

27. The system of claim 25 wherein at least one of the first support layer and the second support layer has a thickness in the range of 0.005 inches to 0.030 inches.

28. The system of claim 25 further comprising:

means for measuring resistance across the plurality of switches; and means for controlling the appliance in response to the measured resistance across one or more of the plurality of switches.

29. An input system, comprising:

an array of touch regions, wherein at least one of the touch regions is aligned with a sensing structure tor sensing a user input, the sensing structure comprising:

a first conductive region;

a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed;

wherein the first conductive pattern and the second conductive pattern form a plurality of spirals.

30. An input system, comprising:

an array of touch regions, wherein at least one of the touch regions is aligned with a sensing structure for sensing a user input, the sensing structure comprising:

a first conductive region;

a second conductive regions aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region, and the second conductive region, the third conductive region electrically coupling the first switch terminal to the second switch terminal to provide a first indication when the switch is open and a second indication when the switch is closed;

wherein electrical current flows between the first terminal and the second terminal whether the switch is open or closed.

31. An input system. comprising:

an array of touch regions, wherein at least one of the touch regions is aligned with a sensing structure for sensing a user input, the sensing structure comprising:

a first conductive region;

a second conductive region aligned with the first conductive region, the second conductive region including a first conductive pattern forming a first switch terminal and a second conductive pattern forming a second switch terminal, the first conductive pattern separated by a space from the second conductive pattern; and a third conductive region between the first conductive region and the second conductive region, the third conductive region electrically coupling the first switch terminal to the second switch terminal to provide a first indication when the switch is open and a second indication when the switch is closed;

wherein a portion of the first conductive region contacts the third conductive region whether the switch is open or closed.

* * * * *